US006378595B2

(12) United States Patent
Zimmerman, II

(10) Patent No.: US 6,378,595 B2
(45) Date of Patent: Apr. 30, 2002

(54) LOW PRESSURE DIE CASTING SYSTEM

(75) Inventor: Richard D. Zimmerman, II, Jackson Center, OH (US)

(73) Assignee: Honda of America Mfg., Inc., Marysville, OH (US)

( * ) Notice: Subject to any disclaimer, the term of this patent is extended or adjusted under 35 U.S.C. 154(b) by 0 days.

(21) Appl. No.: 09/808,273

(22) Filed: Mar. 14, 2001

Related U.S. Application Data

(62) Division of application No. 09/659,347, filed on Sep. 12, 2000, now Pat. No. 6,257,313, which is a division of application No. 09/295,261, filed on Apr. 20, 1999, now Pat. No. 6,186,219.

(51) Int. Cl.[7] ..... B22C 19/04

(52) U.S. Cl. ..... 164/155.3; 164/119; 164/306

(58) Field of Search ..... 164/457, 119, 164/306, 113, 312, 151, 154.8, 155.3

(56) References Cited

U.S. PATENT DOCUMENTS 4,741,381 A 5/1988 Nishida et al.

*Primary Examiner*—Kuang Y. Lin
(74) *Attorney, Agent, or Firm*—Rankin, Hill, Porter & Clark LLP

(57) ABSTRACT

A control system and method for controlling a low-pressure die casting machine wherein the pressure within the dies more accurately tracks the desired recipe pressure. The control system senses pressure in the dies and compares the sensed pressure to desired pressure. Should the difference between the sensed pressure and the desired pressure be indicative of a problem in the casting operation, subsequent casting cycles are prevented. Should the difference between the sensed pressure and the desired pressure be indicative of a potential catastrophic failure, the current casting cycle is immediately terminated, thereby minimizing the possibility of catastrophic failure. The control system has commercially available and easily replaceable components and, thus, can be quickly repaired to reduce machine downtime should any component fail.

4 Claims, 5 Drawing Sheets

LOW PRESSURE DIE CASTING SYSTEM

This application is a Div. of Ser. No. 09/659,347 filed Sep. 12, 2000 now U.S. Pat. No. 6,257,313 which is a Div. of Ser. No. 09/295,261 filed Apr. 20, 1999, now U.S. Pat. No. 6,186,219.

BACKGROUND OF THE INVENTION

1. Field of the Invention

The present invention is generally directed toward low-pressure die casting and, more particularly, toward a pressure control system and method for controlling the pressurization of low pressure die casting machines.

2. Description of the Related Art

With reference to FIG. 1, a conventional die casting machine 10 is shown to include a crucible 12, a movable upper die 14, and a fixed lower die 16. The upper die 14 moves from an upper position spaced from the lower die 16 to a lower position abutting the lower die 16. Seals (not shown) fluidly seal the upper die 14 to the lower die 16. Sand-based cores 20 are received between the upper and lower dies 14, 16, and are used as the mold for forming cast parts.

The crucible 12, which receives and contains molten aluminum 22, has a pressurization input 24 by means of which pressurized air is introduced into a chamber or space 26 in the crucible 12 relatively above the molten aluminum. One or more riser tubes 28 conduct molten aluminum 22 from the crucible 12 upwardly to the dies 14, 16. Pressure developed in the space 26 forces the molten aluminum upwardly through the riser tubes 28 and around the sand cores 20. Typically, air pressure of between about 3–20 psi is used in low pressure die casting operations.

With reference to FIG. 2, a conventional control system for the die casting machine of FIG. 1 is schematically illustrated. The conventional control system includes a master programmable logic controller (master PLC) 30, a pressure controller 32, and a series of remote sensing and input/output stations or units 34.

Each of the remote units 34 provide input/output transfer and signals indicative of a sensed parameter, such as temperature and physical condition of various components (i.e., dies open/closed, valve open/closed etc.). The master programmable logic controller 30 (master PLC) holds the main program for die casting machine control. The pressure controller 32 receives, from the master PLC 30, signals generated by the remote units corresponding to various sensed parameters to start pressurization.

With reference to FIG. 3, a typical mass production recipe is illustrated. The mass production recipe program 38 includes an initial pressure ramp-up period (A), a subsequent constant-pressure period (B), and a pressure exhaust or release period (C). During the initial pressure ramp-up period, pressure within the dies increases. During the constant-pressure period (B), pressure within the dies should remain constant or static. During the pressure release period, air pressure is released from the crucible. Thereafter, the dies are opened, the cast parts are removed, and the dies are prepared for a subsequent casting cycle.

With continued reference to FIG. 3, the pressure ramp-up period includes a first portion (A') and a second portion (A"). During the first portion (A'), pressurized air is introduced into the space 26 in the crucible 12 above the molten aluminum 22 and begins to force the molten aluminum up the riser tubes 28 toward the dies 14, 16. During the second or subsequent portion (A") of the ramp-up period (A), molten aluminum is forced out of the riser tubes 28 and between the dies. The second portion (A") of the ramp-up period (A), which immediately precedes the constant pressure period (B), essentially ends when the dies 14 and 16 are full of molten aluminum.

During the constant-pressure period (B), the molten aluminum in the core 20 solidifies. Following the constant-pressure period (B), pressure is exhausted (C) from the crucible, the dies 14, 16 are opened, the formed part and cores 20 are removed from the dies, and the dies are prepared for a subsequent molding operation. The pressure ramp-up period (A) is much shorter than the constant pressure period (B). Typically, the pressure ramp-up period (A) is between about 10–20 seconds in length whereas the constant pressure period (B) is between about 200–400 seconds in length, depending upon the part being cast.

The great disparity between the relative length of the pressure ramp-up and constant pressure periods (A, B) has resulted in the prior art system not being able to numerically display or track pressure during the pressure ramp-up period (A). Accordingly, as shown in FIG. 3, the user has no numeric display of the difference between actual and desired pressure 40, 38 during the pressure ramp-up period (A). Rather, the system only shows the actual pressure 40 during the constant pressure period (B).

The aforementioned control system and method has generally worked satisfactorily in the past, but suffers from several disadvantages. Firstly, low-pressure die casting machines have numerous seals that have a tendency to leak over time. Unfortunately, the conventional system is ill equipped to compensate for such leakage. Accordingly, there tends to be wide variations in the actual pressure as compared to the desired or recipe pressure. Typically, a variation of ±8% between the actual pressure and desired recipe pressure occurs with the conventional system.

Also, in the conventional system, there is no means to monitor the system for gross pressure loss or lack of pressure at the beginning of the pressurization cycle (during the ramp-up period A), which would be indicative of potential catastrophic failure. As noted previously, the actual pressure 40 is not numerically displayed during the pressure ramp-up period, and no control action is taken if the actual pressure deviates significantly from the desired recipe pressure. Catastrophic failure could be the result of, for example, misalignment of the dies 14, 16, a missing sand core 20, or failure of the seals between the dies. Therefore, in the conventional system it is possible for molten aluminum 22 to be introduced into the dies 14, 16 and to leak from the dies and out of the casting machine 10, possibly causing a fire or explosion.

Finally, in the conventional system, if there is a malfunction of the pressure controller, which is proprietary, the entire die casting machine is inoperable. Such a malfunction could simply be a loss of the display unit for the pressure control system. Therefore, it is necessary to retain in inventory replacement components that are specifically dedicated to the conventional pressure control system in order to avoid or minimize costly machine downtime.

Therefore, there exists a need in the art for a pressure control system that will more accurately control the actual pressure to track the desired pressure. There also exists a need in the art for a pressure control system that will anticipate and prevent catastrophic failure. Finally, there exists a need in the art for a low pressure die casting control system that uses standard, commercially available components.

SUMMARY OF THE INVENTION

The present invention is directed toward a control system for a low-pressure die casting machine wherein the pressure within the dies more accurately tracks the desired recipe pressure. The present invention is also directed toward a control system that tracks initial pressurization in the dies with real time data collection and stops the casting operation should the detected pressure be indicative of a catastrophic failure. The present invention is also directed toward a method for controlling the die casting system to minimize the occurrence of catastrophic failures. The present invention is further directed toward a control system that has generic, easily replaceable components and, thus, can be quickly repaired to reduce machine downtime should any component fail.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS

Figure 1:
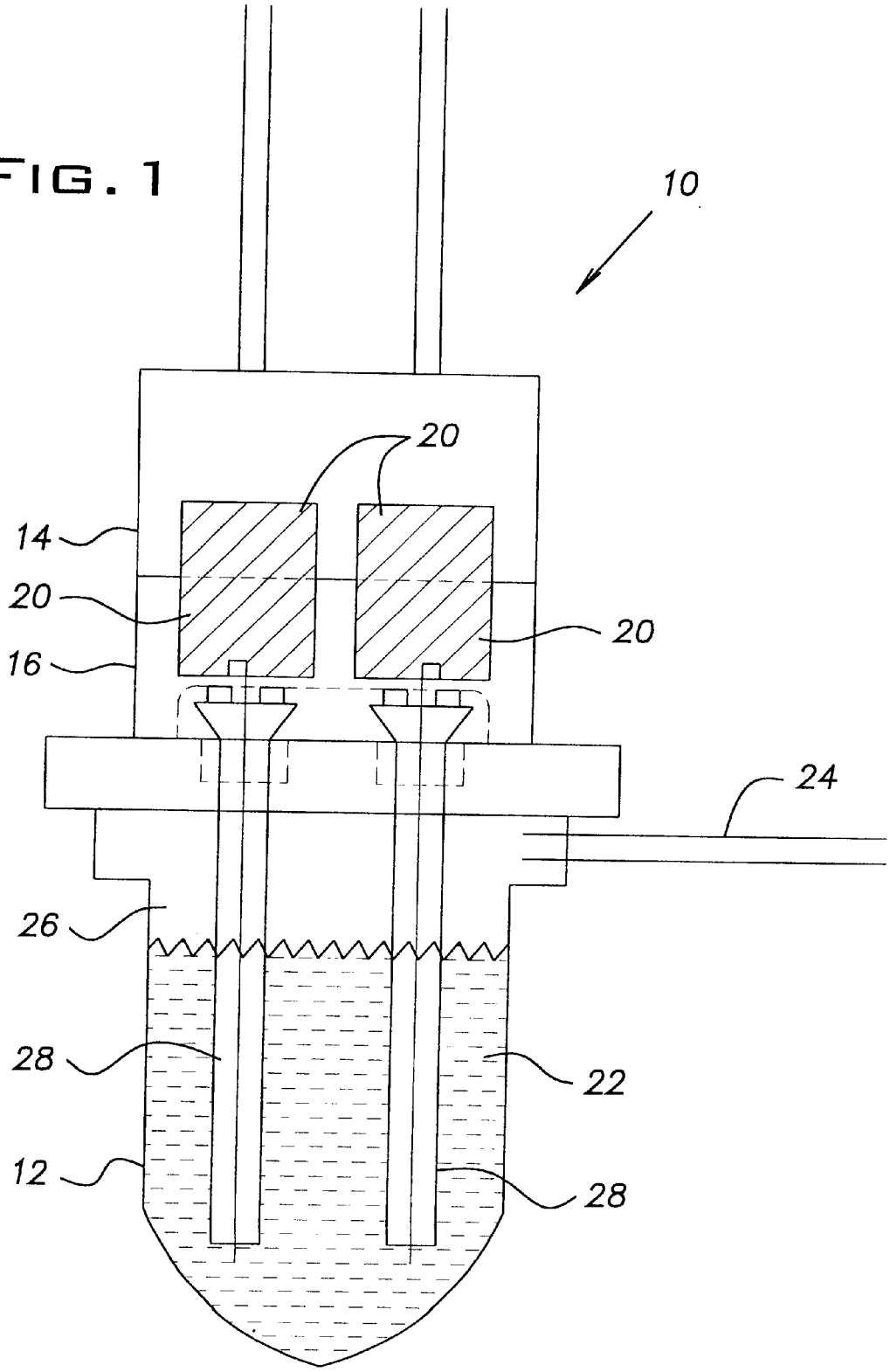
FIG. 1 schematically illustrates a conventional low-pressure die casting machine.
Figure 4:
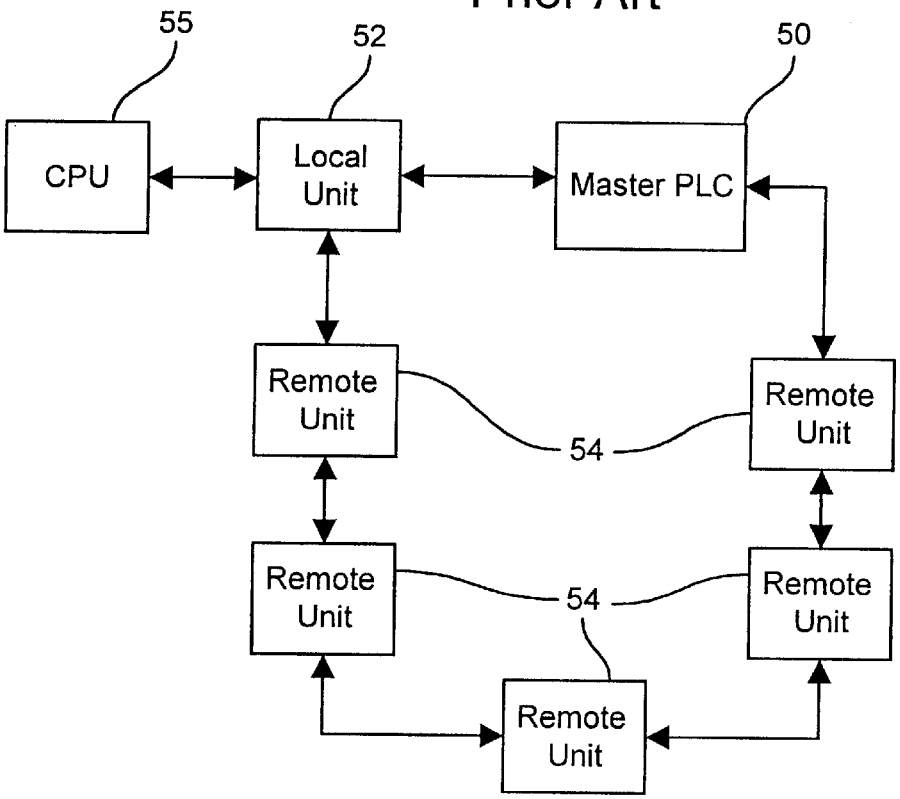
FIG. 4 schematically illustrates a control system for a low-pressure die casting machine according to the present invention.
Figure 3:
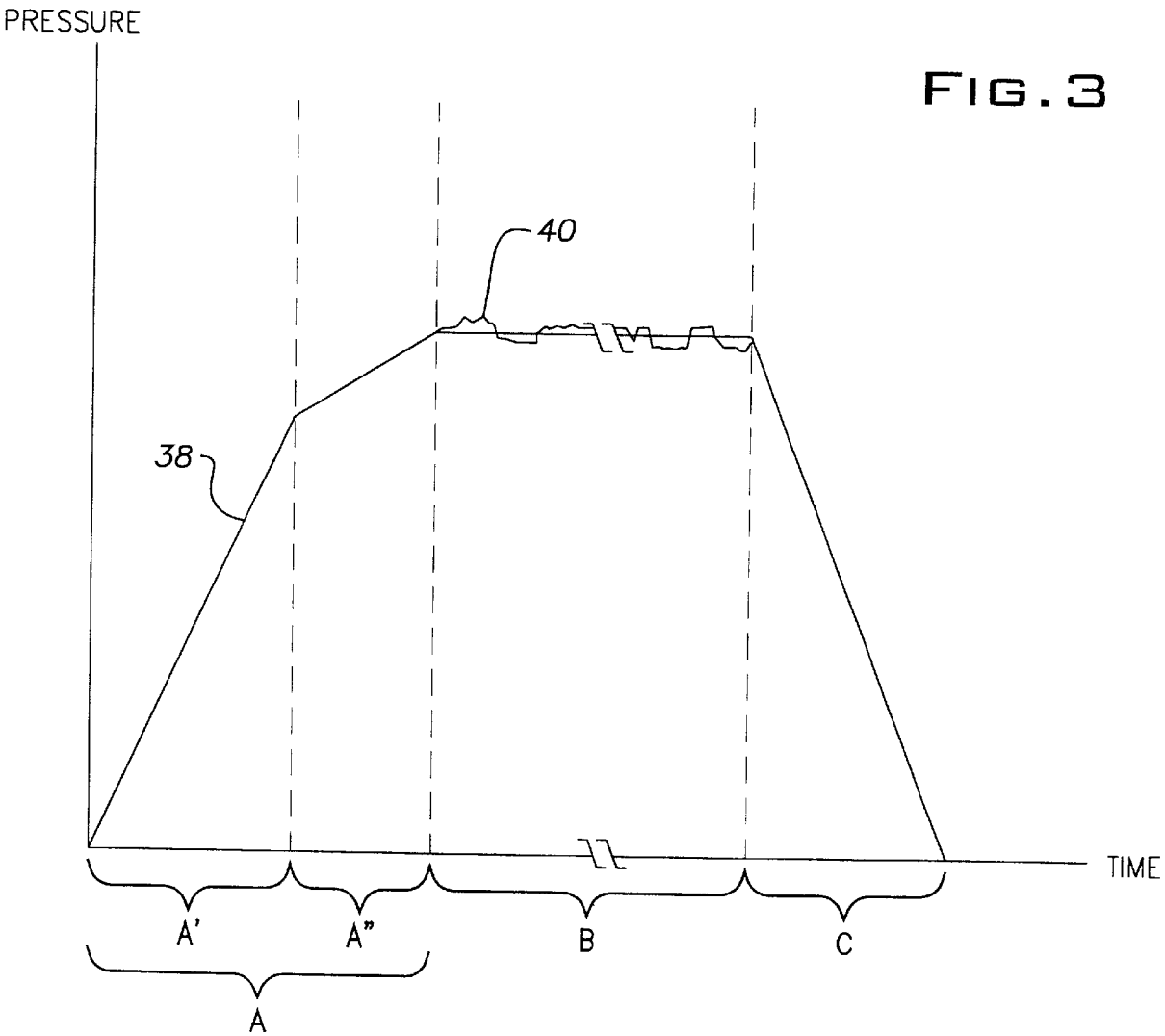
FIG. 3 is a graph illustrating a desired mass-production pressure recipe and the displayed actual pressure curve derived using the conventional control system of FIG. 2.

With reference to FIG. 4, a control system for a low-pressure die casting machine according to the present invention is illustrated. The control system, which is used to control the conventional die casting machine illustrated in FIG. 1, includes a master PLC 50, a local unit 52, a series of remote units 54 in series with the local unit 52 and the master PLC 50 for sensing the input/output, and a CPU unit 55 in parallel with the local unit 52.

Figure 2:
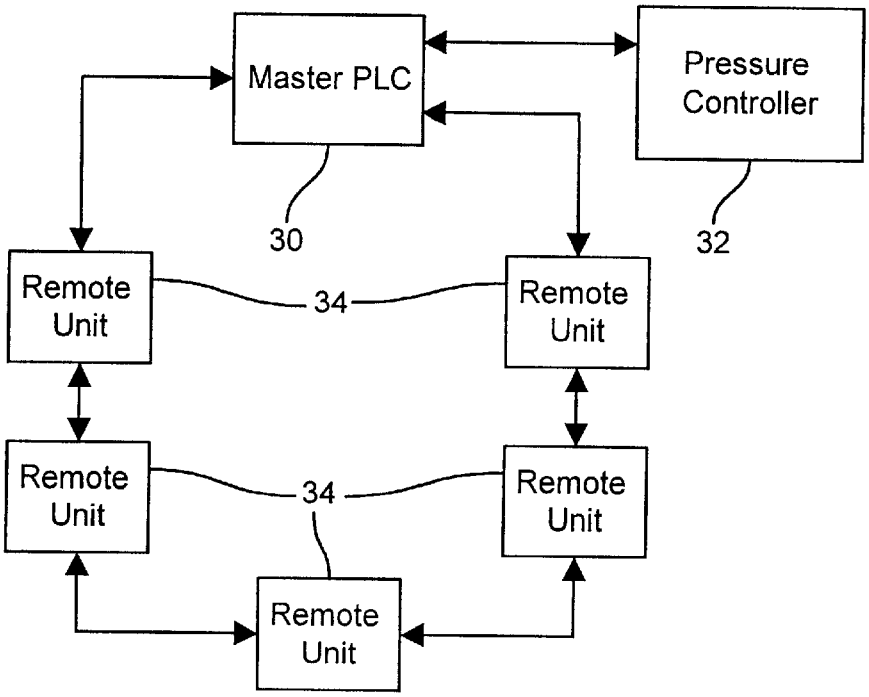
Fig. 2 Prior Art
FIG. 2 schematically illustrates a conventional control system for a low-pressure die casting machine.

The remote units 54, like the remote units previously discussed with regard to the conventional control system illustrated in FIG. 2, sense various physical parameters of the die casting machine and/or the die casting process, and provide input/output transfer. These physical parameters include at least the state of the dies (open/closed), the condition of various switches, and die temperature. Each of the remote units 54 transmits signals related to the specific sensed parameter, and receives and transmits or transfers signals from the other remote units to the local unit 52 through the master PLC 50.

The local unit 52 is connected to the CPU unit 55 which runs the man-machine interface (MMI) and graphical display unit, and permits the user to access and change parameters of the desired pressure recipes, which are stored in the local unit 52. Notably, and as will be discussed more fully hereinafter, the CPU unit 55 may be easily replaced by a commercially available component, such as a laptop computer. Preferably, the CPU unit 55 uses commercially available interface and graphical display software, such as RSVIEW by Rockwell International that provides desired features. In addition, a touch screen interface to facilitate data input and movement between various screens and menus may be provided. Such software will also provide desired security features, such as passwords and access limitations, to prevent unauthorized access to sensitive casting operation parameters, such as the desired pressure recipe stored in the local unit 52 but accessible via the master PLC 50.

Data is exchanged between the master PLC 50 and the local unit 52, typically as handshaking input/output. The data exchanged includes the parameters sensed or measured by the remote units 54.

The user will be able to vary some of the process parameters of the local unit 52 within predetermined limits, such as fill shot number (described hereafter), the constant pressure hold time (length of constant pressure period B) and the pressure exhaust hold time (length of exhaust period C).

The fill shot number is used by the local unit 52 to compensate for the decreasing volume of molten aluminum 22 in the crucible 12 as cast parts are formed. When a predetermined volume or charge of molten aluminum 22 is placed in the crucible 12, and casting begins, the fill shot number is normally zero. As parts are cast, the volume of molten aluminum in the crucible 12 drops, and relatively more pressurized air must be introduced into the space 26 in the crucible 12 above the molten aluminum 22 to get the constant, desired volume of aluminum to flow into the cores 20. Accordingly, a pressure adjustment is calculated by the local unit 52, such that:

$$\text{Pressure adjustment} = \text{offset} * \text{fill shot number};$$

wherein, "offset" is a constant based upon the cast part volume and the initial volume of molten aluminum in the crucible 12, and fill shot number is nominally equal to the number of parts made with the current charge of aluminum. The local unit 52 uses the calculated pressure adjustment to generate a higher pneumatic volume introduced into crucible 12, that will compensate for the volume of aluminum reduced, in a consistent cycle time. The user may change the fill shot number should it be apparent that the actual pressure is lagging the desired pressure, indicative of the need for increasing the pressure adjustment.

A maximum fill shot number is stored in the local unit 52 and compared to the current fill shot number. An alarm and optional machine shut-down (cycle stop) are actuated when the maximum fill shot number is reached to prevent the casting machine from running out of molten aluminum, before or during the casting process, which would cause machine downtime and/or die downtime resulting from partial filling of dies 14 and 16.

Figure 5:
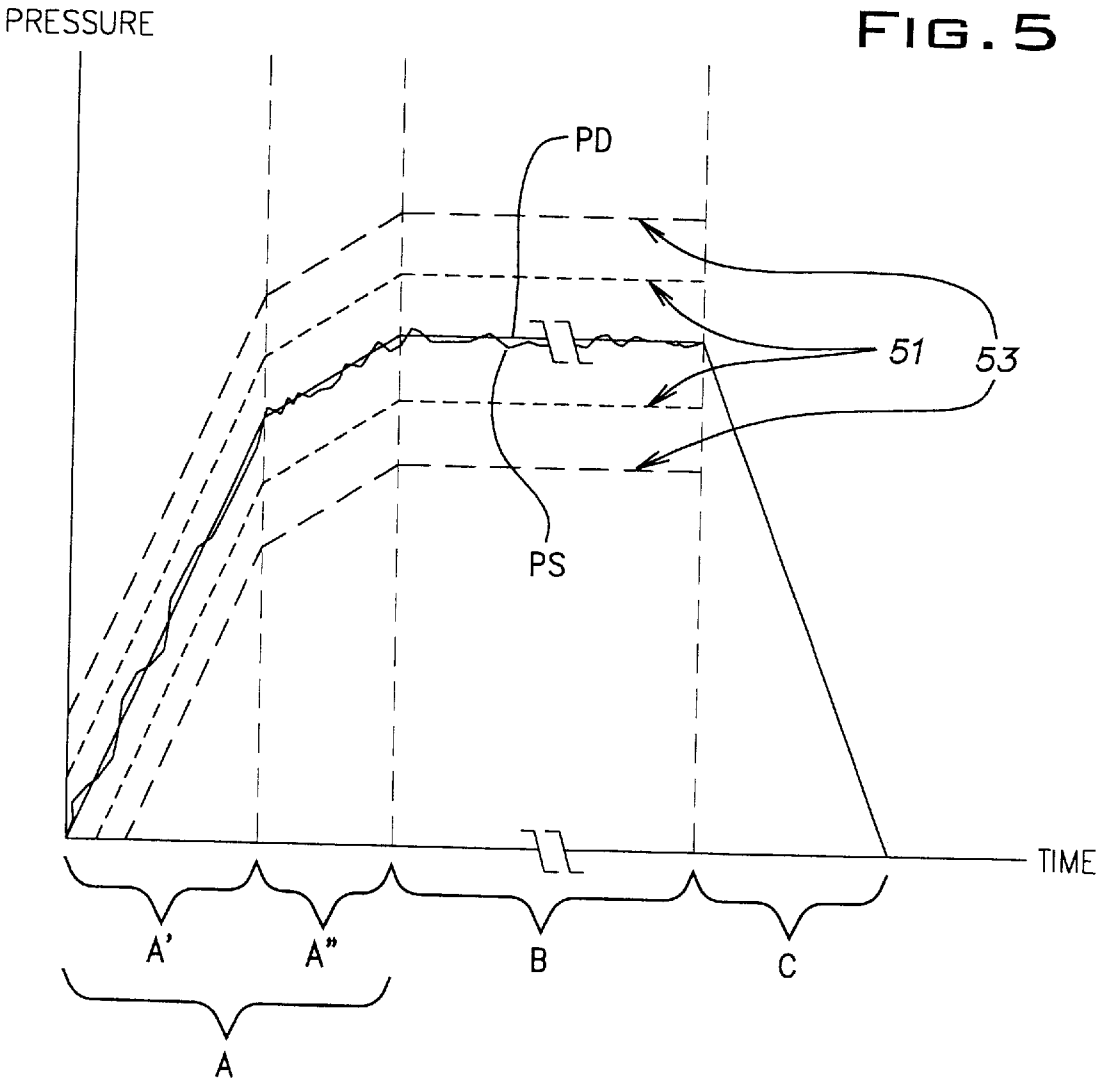
FIG. 5 is a graph illustrating a desired mass-production pressure recipe and the displayed actual pressure curve derived by using the control system according to the present invention shown in FIG. 4; and, FIG. 6 is a flow chart illustrating a method for controlling a low-pressure die casting machine during a mass production cycle according to the present invention.
Figure 6:
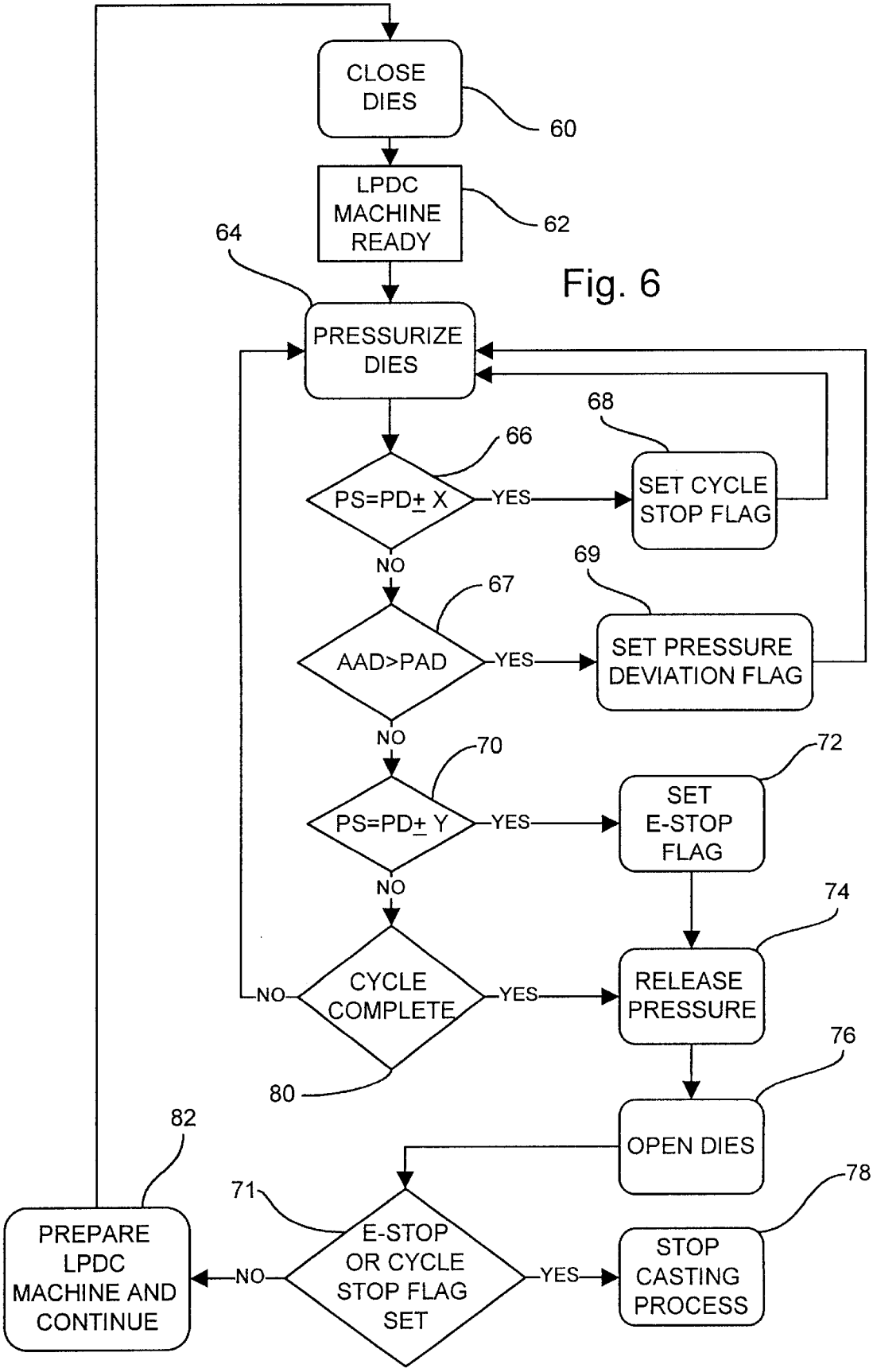

With reference to FIGS. 5 and 6, a method for controlling a low pressure die casting machine with the previously discussed control system is illustrated. The low pressure die casting machine 10 is used in a continuous or sequential casting process wherein a large number of parts are cast one after the other. After a charge or predetermined volume of molten aluminum 22 is introduced into the crucible 12, parts are cast until the charge is exhausted or the maximum fill shot number is reached. Thereafter, a new charge of aluminum is introduced into the crucible 12. The number of parts that can be cast is related to the predetermined or initial aluminum volume and the size of the parts being formed.

The machine 10 is readied for each casting cycle in the casting operation by cleaning the dies 14, 16, and inserting cores 20 into the dies 14, 16. The dies are closed at step 60, the machine is ready at step 62, and pressurization begins at step 64.

Throughout pressurization of the dies, the local unit 52 opens and closes one or more air valves (not shown) to have actual or measured pressure match desired recipe pressure. Although the actual pressure with the present invention is normally ±2.5% and, more specifically, ±1% of the desired recipe pressure, the difference between actual and desired pressures has been magnified in FIG. 5 for clarity.

As shown in FIGS. 5 and 6, a first or inner limit is established such that if actual or sensed pressure (PS) deviates from desired pressure (PD) by a predetermined amount (X), a cycle stop flag 68 is set in the local unit 52 to stop the casting operation at the end of the current cycle and the casting cycle continues. Such a deviation is indicative of a problem in the casting machine or casting process that needs to be investigated, but not such a problem that the cycle must be immediately stopped. At the end of the cycle at step 80, pressure is released at step 74 (C), the dies are opened at step 76, and it is determined whether the cycle stop or e-stop flag is set at step 71. Since the cycle stop flag was set in step 68, the casting process is stopped and a visual and/or audio alarm will alert the operator that inspection of the machine is required. The cycle stop flag must be reset before a subsequent casting cycle can be initiated.

A second or outer limit is also established such that if actual pressure (PS) deviates from desired pressure (PD) by a predetermined amount (Y) within a given amount of time, an E-stop flag is set in step 72 in the local unit 52 and the casting cycle is stopped immediately. Such a deviation is indicative of a potentially catastrophic failure in the casting machine or casting process that needs to be investigated before the casting operation can continue. Accordingly, pressure is released at step 74, the dies are opened at step 76, and, since the E-stop flag is set, the casting process is stopped at step 78. Suitable visual and audio alarms will alert the operator to the condition of the machine 10. The E-stop flag will have to be reset prior to restarting of the casting operation.

The average difference (AAD) between the actual pressure and the desired pressure recipe is also calculated at step 67. If the average difference exceeds a predetermined amount (PAD), it is indicative of some error in the machine or system, such as a low shot fill number. Pressure deviation flag 69 is set and an alarm indicates to the user that a potential problem exists and should be investigated prior to the next casting cycle. However, the setting of pressure deviation flag 69 does not stop the current cycle or future cycles.

If casting proceeds normally, at the end of the pressure cycle (end of constant pressurization B) at step 80, pressure is released 74 (C), the dies 14, 16 are opened 76, the cast parts are removed from the dies, and the machine 10 is prepared for the next casting cycle at step 82.

Typically, the time in FIG. 5 is measured in seconds and the pressure is measured in g/cm$^2$. In a casting machine employing the present invention, the transition between the first portion A' and the second portion A" of the pressure ramp-up period occurs at a pressure of about 75 g/cm$^2$, the predetermined amount for cycle stop purposes (X) has been selected as 10 g/cm$^2$, the predetermined amount for e-stop purposes (Y) has been selected as 20 g/cm$^2$, and the maximum average deviation has been selected as being about 5 g/cm$^2$. It is considered apparent that these values are one example, and that the present invention is not limited thereto.

When employing the pressure control system of the present invention, repeatability of recipe accuracy is assured, within about ±3%, significantly reducing scrap and downtime resulting from uncontrollable large pressure deviations.

While the preferred embodiment of the present invention is shown and described herein, it is to be understood that the same is not so limited but shall cover and include any and all modifications thereof which fall within the purview of the invention.

What is claimed is:

1. A low pressure die casting system, comprising:

a low pressure die casting machine, said machine including:

a crucible that is adapted to hold a volume of molten metal, said crucible defining a space relatively above into which a pressurizing gas is introduced via a pressure port;

a pair of dies for receiving and supporting cores, said cores serving as molds for forming a cast part;

means for communicating molten metal from the crucible to the dies under influence of pressure developed in the space above the molten metal; and, a control system for controlling pressure in the space above the molten metal, said control system comprising:

means for introducing pressurized air into said space;

means for releasing pressurized air from said space;

a local unit which stores a desired pressure versus time recipe, said local unit controlling said means for introducing pressurized air and said means for releasing pressurized air, and being operable to detect pressure in the space above the molten metal and to compare said detected pressure to said desired pressure versus time recipe;

a CPU unit that is connected to said local unit that provides a man-machine interface, said local unit receiving data from said CPU unit; and, a remote unit in communication with said local unit, said remote unit determining when said pair of dies is closed and ready for pressurization.

2. A low pressure die casting system according to claim 1, wherein said local unit compares said detected pressure to said desired pressure recipe to detect divergence between desired pressure and actual pressure, said local unit being operable to terminate said casting cycle before an end of said casting cycle should said detected divergence equal a first predetermined amount.

3. A low pressure die casting system according to claim 2, wherein said local unit is operable to terminate said casting process at an end of said casting cycle should said detected divergence be equal to a second predetermined amount, said second predetermined amount being less than said first predetermined amount.

4. A low pressure die casting system according to claim 1, wherein said local unit is operable to calculate an average difference between said detected and desired pressures throughout at least a portion of said pressurization, and to terminate said casting process at an end of said casting cycle should said average difference be greater than a predetermined maximum average.

* * * * *